United States Patent [19]

Podszus

[11] Patent Number: 4,502,495

[45] Date of Patent: Mar. 5, 1985

[54] APPARATUS FOR MAKING HELICAL CENTER-CORED SMOKERS' FILTERS AND METHOD

[76] Inventor: Hans Podszus, 62 Hope Dr., Bella Vista, Ark. 72714

[21] Appl. No.: 571,201

[22] Filed: Jan. 16, 1984

[51] Int. Cl.[3] ..... A24D 3/04; A24F 3/02; A24F 9/00

[52] U.S. Cl. ..... 131/328; 131/329; 131/209; 131/217

[58] Field of Search ..... 131/329, 328, 202, 209, 131/217

[56] References Cited

U.S. PATENT DOCUMENTS 2,205,553 6/1940 Blair ..... 131/202

*Primary Examiner*—V. Millin

*Attorney, Agent, or Firm*—Robert R. Keegan

[57] ABSTRACT

There is disclosed apparatus and method for making helical center-cored smokers' filters from pipe cleaners or the like in which a guide for winding the pipe cleaner includes a thin walled metal tube with an inside diameter slightly smaller than the pipe cleaner and a wire affixed to the outside of the tube in the shape of a helix. The pipe cleaner is put in the tube for a fraction of its length and is then wound along the guide around the tube and itself by the use of a transparent plastic hollow cylinder slipped over the tube and with a pipe cleaner engaging notch in one end. An opening in the cylinder allows a fully wound pipe cleaner to be held in place while the guide is rotated and disengaged from it after which the wound pipe cleaner filter is pushed out of the cylinder and removed.

19 Claims, 5 Drawing Figures

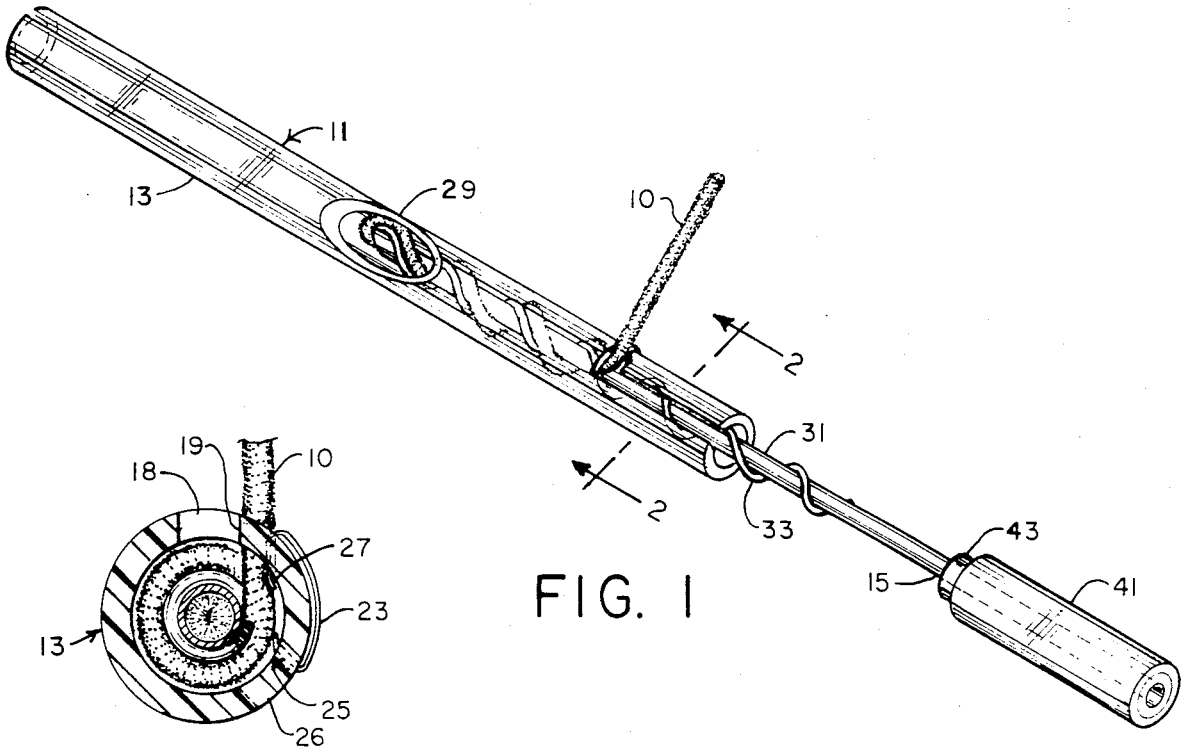
FIG. 1
FIG. 2
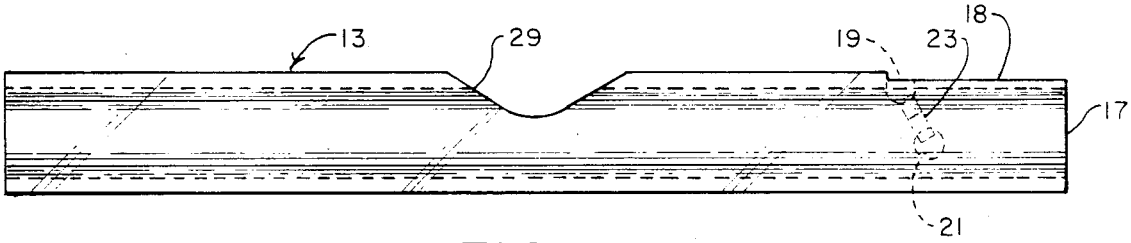
FIG. 3
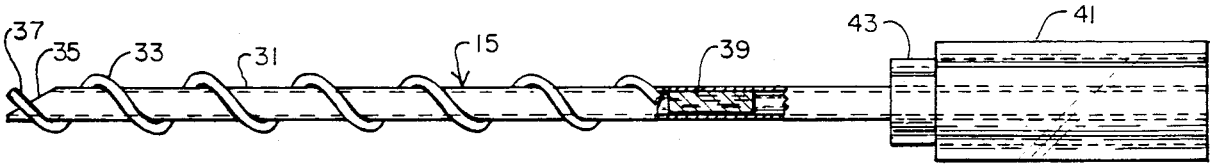
FIG. 4
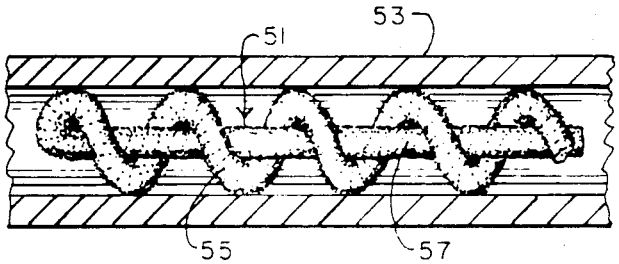
FIG. 5

APPARATUS FOR MAKING HELICAL CENTER-CORED SMOKERS' FILTERS AND METHOD

The present invention relates to an apparatus and method for making filters for pipes or cigarettes holders specifically and which could be adapted to making filters for other uses.

According to the invention conventional pipe cleaners such as those made and sold by United States Tobacco Company, Nashville Tenn., under the brand name, Dill's Pipe Cleaners, are employed in the present invention to make a helical center-cored smokers' filter to fit in a pipe with a filter chamber or a cigarette holder with a filter chamber. The pipe cleaner in this description will be understood to refer to a pipe cleaner according to dictionary definition and also to any elongated brushlike structure having a permanently deformable center of wire or other material. Pipe cleaner is defined in the Webster's Seventh New Collegiate Dictionary, published 1971 by G.N.C. Merriam Company, as " . . . specifically: a piece of flexible wire in which tufted fabric is twisted and which is used to clean the stem of a tobacco pipe."

The apparatus and method according to the invention are used to form from a pipe cleaner a filter approximately two inches long and approximately one-quarter inch in diameter to fit in the filter chamber of a filter pipe or filter cigarette holder. The method and apparatus are capable of manual use and are so described. Further apparatus could be employed to automate the method to any desired extent. The filter consists of a central core formed by a straight section of pipe cleaner and a helical winding around the straight section with the result that smoke passing through the filter chamber of a pipe is caused to travel a spiral path approximately twice as long as the straight line path through the chamber. In the course of this travel the smoke tends to come in contact with the fibers of the pipe cleaner which trap tar and other deleterious substances from the tobacco smoke.

The filters are, of course, disposable and would normally be replaced after about two pipefuls of pipe tobacco or an equivalent amount of cigarette tobacco smoking. Filters made according to the method and apparatus of the invention have been found to collect a markedly greater amount of tar and other materials from the tobacco smoke as compared with commercially available filters of other structures and materials. While this results in frequent change of the disposable filters the low price of the material from which they are made and the simplicity and rapidity with which they can be made alleviates any disadvantage to frequent filter changing, which is of course a direct consequence of superior performance of the filter.

The princple by which the filter operates is believed to be primarily mechanical entrapment of suspended solids and liquids, but chemical or electrostatic effects may be present which are not presently understood.

The method involves winding the pipe cleaner back on itself in a spiral or helix, wherein the twisted part of the pipe cleaner has a length of about twice that of the straight part, and the helix angle of the twisted part is approximately 30°. The method starts with placing the straight part of the pipe cleaner in a tube with a sufficiently close fit to cause the straight part fibers to be compressed significantly. The twisted part is wound quite tightly around the tube with the result that as the filter is removed from the apparatus and the straight part is removed from the tube on which it is wound, the fibers of the straight part of the cleaner and the twisted part of the cleaner intermesh so there is no large opening for passage of tobacco smoke other than the helical path through the filter. In an alternative arrangement part of the straight portion of the filter could be eliminated before or after winding to permit an additional small central opening in a portion of the filter and thus reduce the resistance to flow through the filter. Obviously a slight reduction in the effectiveness of the filter would result from the latter procedure, but its effectiveness would still be high relative to other available tobacco smoke filter devices of comparable size and shape. While the invention has been discussed with respect to pipe and cigarette holder filters, it is obvious that it could be applied to other fluid filters which in some cases would require a change of scale or proportion of the device.

It has long been known that pipe cleaners are susceptible of being formed into more or less effective filters for pipes or cigarette holders, and such filters have been made in straight form and have also been made in the form of a spiral or helix. In at least one case, a filter has been made with a spiral of pipe filter material around a separate central core of the same material, see U.S. Pat. No. 1,985,365 for "Tobacco Pipe" issued Dec. 25, 1934 to MacDouglad Dexter. Other patents showing pipe cleaners or similar materials formed into a filter are shown in the following U.S. Pat. Nos., 2,720,204 for "Tobacco Pipe" to H. Ryder, issued Oct. 11, 1955; 2,092,002 for "Smoking Pipe" to T. M. Mincer, issued Sept. 7, 1937; 1,563,866 for "Pipe" to A. Kortejarvi, issued Dec. 1, 1925; and 2,417,978 for "Smoking Pipe" to A. Gieger, issued Mar. 25, 1947.

The above referenced patents for the most part do not shown either apparatus or method for construction of a helical filter. The above references or any other known references do not in particular show an apparatus or a method for forming a pipe cleaner into a filter having a helical portion which is wound back on a straight portion of the cleaner. Apart from the advantages of the filter construction produced by the present apparatus and method, the apparatus and method themselves represent an important advance by giving the capability of quickly and easily producing highly effective filters from inexpensive starting material. Smokers are thereby encouraged to use and frequently replace the filters after only one or a few smokes while the filter efficiency is at its greatest level.

In addition to providing the above features and advantages, it is an object of the present invention to provide an apparatus which may be manually operated without great skill or extended practice to quickly produce a helically wound self-cored filter of pipe cleaner material.

It is another object of the present invention to provide a pipe cleaner filter making apparatus which can be operated rapidly to tightly wind a pipe cleaner in a helix back upon a portion of itself with a pitch of about one-half inch to provide a highly efficient filter for the removal of tar and other deleterious elements from cigarette smoke in a smoking device having a chamber in the path of the smoke stream to receive such a filter.

It is still another object of the present invention to provide a method for making a smokers' filter out of a conventional pipe cleaner by winding the pipe cleaner tightly back upon itself with a pitch of about one-half inch to form a filter about two inches long and about one-quarter inch in diaemter with an essentially helical smoke path approximately four inches long.

Other objects and advantages will be apparent from consideration of the following description in conjunction with the appended drawings in which:

FIG. 1 is an isometric view of the apparatus of the invention being employed to practice the method of the invention;

FIG. 2 is a sectional view taken along the lines 2—2 in FIG. 1;

FIG. 3 is a side elevational view of the hollow cylindrical portion of the apparatus of FIG. 1;

FIG. 4 is a side elevational view of the tube and helical guide portion of the apparatus of FIG. 1; and FIG. 5 is a fragmentary view showing a filter made in accordance with the invention in place in a filter chamber of a smoking device.

Referring now to the drawings and particularly to FIG. 1, filter-making apparatus 11 is shown including a winding element 13 and a mandrel and guide element 15. The guide element 15 is also shown in FIG. 2 and FIG. 4 and includes a thin-walled tube 31 of brass or other material around which is wound a wire 33 of copper to form a helical guide. Wire 33 may be secured to tube 31 by brazing, soldering, cementing with adhesive or in other suitable fashion. The end 35 of tube 31 is cut at an angle to form a notch and the end 37 of wire 33 extends slightly beyond the bottom of the end opening 35 for tube 31. Wire 33 and tube 31 may be replaced by a tube and helix of other material including but not limited to molded plastic.

A plug 39 of cork, rubber, or other suitable material fits snugly within tube 31 and acts as a stop for a pipe cleaner 10 inserted into tube 31 from end opening 35. Very firm pressure on a pipe cleaner 10 or other probing tool will move plug 39 so that the stop point is adjustable.

A handle 41 is secured on tube 31. In the illustrated embodiment handle 41 is formed of the same hard transparent plastic as is the winding element 13 and a soft plastic tube 43 is utilized which is internally a close fit on tube 31 and externally a close fit within handle 41.

Winding element 13 is also shown in FIGS. 2 and 3; it is primarily formed of hollow rigid transparent plastic tube and has a slot 18 in end 17 which accomodates a pipe cleaner 10. Slot 18 has a notch 19 near its inner end thereby forming an L-shaped opening which effectively captures the pipe cleaner 10 to wind it about tube 31 guided by helical wire 33.

A spring clip 23 formed of a strip of resilient metal such as brass has an end 27 acting as a finger which tightly presses on pipe cleaner 10 as it is wound on tube 31 with the result that pipe cleaner 10 is wound in a very tight helix; it also presses down the end of the pipe cleaner as the winding is completed. Clip 23 is held in place by end 27 which engages notch 19 and opposite end 25 which engages the edge of a hole 26 provided for that purpose. A larger opening 29 is provided approximately midway of winding element 13 which allows the twisted portion of pipe cleaner 10 to be gripped with a finger while mandrel and quide element 15 is unwound from the completed pipe cleaner. Opening 29 is an optional feature. Other means for holding pipe cleaner while mandrel and guide element 15 are withdrawn may alternatively be employed. Winding element 13 may be formed of other than transparent plastic material and may assume various shapes so long as it properly engages and bends the cleaner being wound on itself.

FIG. 5 shows a filter 51 made according to the method of the invention as it would appear in place in a filter chamber 53 of a pipe or cigarette holder. It will be noted that upon removal from the apparatus in accordance with the method the tufts or bristles of the pipe cleaner expand from their compressed state with the result that the twisted portion 55 of filter 51 is closely wound around the straight portion 57 of filter 51 with no significant gap or opening therebetween. This causes the smoke to be forced essentially in a helical path through the filter which is much longer than a straight path through the filter chamber and produces greater opportunities for entrapment of tar and deleterious elements in the tobacco smoke.

The method of forming a filter with the illustrated apparatus according to the invention proceeds as follows: The guide element 15 is separated from the winding element 13 if necessary. It should be noted that for storage the small diameter portion 43 of handle 41 fits snugly in the end of winding element 13 holding the two elements together in telescoped fashion.

A pipe cleaner which will be assumed to be of six inches in length for this example is placed with one end in tube 31 and with the free end extending from end opening 35. Approximately two inches of the pipe cleaner are within tube 31 and four inches extend outside thereof. The helix angle of 30° will cause the wound portion of the pipe cleaner to be twice the corresponding unwound portion. Preferably the position of plug 39 is adjusted so that the pipe cleaner is so positioned when its end comes in contact with plug 39 acting as a stop.

Pipe cleaner 10 is bent into the notch in open end 35 up to but not greatly in excess of 90°. Winding element 13 has its slotted end placed over the end of guide element 15 so that pipe cleaner 10 is in slot 18. Handle 41 of guide element 15 is rotated clockwise relative to winding element 13 so that pipe cleaner 10 is captured in notch 19. Slight backward pressure is applied on pipe cleaner 10 so that notch 19 holds it snugly against helical wire 33. This is important to achieve a tight properly wound filter.

The finger formed by clip end 27 presses on pipe cleaner 10 causing it to wind tightly around tube 31; clip end 27 is also more wear-resistant than the plastic material of winding element 13.

When the free end of pipe cleaner 10 has been completely wound around tube 31 the pipe cleaner may be gripped with the finger through opening 29 while handle 41 is rotated in a counterclockwise direction, thereby withdrawing mandrel and guide 15 from the pipe cleaner 10. If the completed filter does not drop out of winding element 13 it may be easily pushed out with the end of tube 31.

As previously mentioned the process may be slightly altered to make a filter which has a core that does not run its full length. By way of example, the above method could be altered by utilizing a pipe cleaner only five inches long and moving stop 39 to one inch from the end of tube 31, otherwise following the same steps as described above. It is apparent that this alternative method would produce a filter having a core running only one inch or about one-half its length.

From the foregoing description it will be seen that a method and apparatus for forming highly effective smokers' filters is provided. Quite inexpensive pipe cleaners are used as starting material and a simple procedure taking only a matter of seconds produces a filter ready to put in a pipe or cigarette holder filter chamber. The apparatus itself takes up very little space and is relatively inexpensive to manufacture. Various modifications to the apparatus and method have been described or suggested, but other variations and modifications to the apparatus or the method will be apparent to persons skilled in the art and accordingly the apparatus and method are not to be considered limited to the particular embodiments shown or suggested, but rather the scope of the invention is to be determined by reference to the appended claims.

What is claimed is:

1. Apparatus to make helical center-cored smokers' filters from pipe cleaners or other elongated brushlike elements comprising a thin walled tube having an open end for receiving a pipe cleaner at least approximately two inches long and having an inside diameter not greater than the uncompressed diameter of said cleaners, a helical guide having a pitch of less than one-half inch on the outside of said tube extending from said open end to at least about one inch therefrom, a stop in said tube to aid in positioning a pipe cleaner in a predetermined position therein, a winding element including a hollow cylinder having an inside diameter about twice the outside diameter of said thin walled tube, said cylinder having a notch in a first end thereof shaped to engage a pipe cleaner portion extending out of the open end of said tube bent at an angle thereto, a pressure finger near said notch positioned to press said pipe cleaner against said tube while it is rotated around said tube along said helical guide, and an opening in the wall of said cylinder spaced from said open end allowing a wound filter to be held relative to said winding element while said tube and helical guide are rotated to disengage from said filter, whereby a pipe cleaner may be placed with one end in said tube against said stop, said cleaner may be bent at an angle, said winding element may have said first end placed over said tube engaging said cleaner in said notch and be rotated to wind the free portion of said cleaner about said tube and itself to form a helical center-cored smokers' filter.

2. Apparatus as recited in claim 1 wherein said helical guide is a wire bent in helical shape and secured to said tube.

3. Apparatus as recited in claim 1 wherein said notch is an L-shaped notch at least one-half inch long.

4. Apparatus as recited in claim 1 wherein said cylinder is formed at least in part of transparent material.

5. Apparatus as recited in claim 1 wherein said pressure finger is formed of a metal strip extending through an opening into the interior of said cylinder.

6. Apparatus to make helical center-cored smokers' filters from pipe cleaners or other elongated brushlike elements comprising a thin walled tube having a straight section with an open end with a notch for receiving a pipe cleaner having an inside diameter not greater than the uncompressed diameter of said cleaners and being at least approximately two inches long, a helical guide with a pitch of not more than about one-half inch affixed on the outside of said tube extending from beyond the bottom of said notch to at least about two inches therefrom, a stop in said tube to aid in positioning a pipe cleaner in a predetermined position therein, a winding element including a hollow cylinder having an inside diameter about twice the outside diameter of said thin walled tube, said cylinder having an L-shaped slot in a first end thereof shaped to engage a pipe cleaner portion extending out of said first end of said tube bent at an angle thereto, and means for allowing a wound filter to be held relative to said winding element while said tube and helical guide are rotated to disengage from said filter, whereby a pipe cleaner may be placed with one end in said tube against said stop, said cleaner may be bent at an angle, said winding element may have said first end placed over said tube engaging said cleaner in said slot and be rotated to wind the free portion of said cleaner about said tube and itself to form a helical center-cored smokers' filter.

7. Apparatus as recited in claim 6 wherein said helical guide is a wire bent in helical shape.

8. Apparatus as recited in claim 6 wherein said cylinder is formed in part of transparent material.

9. Apparatus as recited in claim 6 wherein said tube is provided with a handle having a reduced diameter portion which is a snug fit in said tool causing said tube to be positionable within said tool for compact storage of said apparatus.

10. Apparatus as recited in claim 6 wherein the helix angle of said helical guide is between 20° and 30°.

11. Apparatus to make helical center-cored smokers' filters from pipe cleaners or other elongated brushlike elements comprising a thin walled tube having an open end for receiving a pipe cleaner, having an inside diameter greater than the minimum compressed diameter of said cleaners, a helical guide on the outside of said tube extending from said open end to at least about two inches therefrom, and a winding tool at least partially of hollow generally circular cross section having an inside diameter at least fifty percent greater than the outside diameter of said thin walled tube, said tool having means near a first end thereof to engage a pipe cleaner portion bent at an angle thereto, whereby a pipe cleaner may be placed with one end in said tube, said cleaner may be bent at an angle, said winding tool may have said first end placed over said tube engaging said cleaner and be rotated to wind the free portion of said cleaner about said tube and itself to form a helical center-cored smokers' filter.

12. Apparatus as recited in claim 11 wherein said helical guide is a wire bent in helical shape and secured to said tube.

13. Apparatus as recited in claim 11 wherein said means to engage a pipe cleaner includes an L-shaped notch in said tool.

14. Apparatus as recited in claim 11 wherein said tool is formed in part of transpatent material in the shape of a hollow cylinder.

15. Apparatus as recited in claim 11 wherein the helix angle of said helical guide is between 25° and 35°.

16. A method for making helical center-cored smokers' filters from tufted or bristled pipe cleaners or other elongated brushlike elements comprising the steps of placing one end of a pipe cleaner in a thin walled tube with an inside diameter not less than the fully compressed diameter of said pipe cleaner while leaving the other end free, making a bend in said pipe cleaner, engaging the free end of said pipe cleaner near the bend therein with a tool having a hollow circular cross section and having a cleaner engaging element portion, and rotating said tool relative to said thin walled tube to cause said pipe cleaner free end to wind helically around said thin walled tube and around itself sufficiently tightly to cause said cleaner, when removed, to have the tufts or bristles of the core portions in part intermeshed with those of the helically wound portion.

17. The method recited in claim 16 wherein the helix angle at which said pipe cleaner is helically wound is between 25° and 35°.

18. The method recited in claim 16 further including the step of rotating said tube relative to said cleaner to disengage the cleaner without altering its shape.

19. The method recited in claim 16 wherein the free end length of said cleaner wound in helical shape is approximately twice the length of the cleaner portion within said tube.

* * * * *